US005211230A

United States Patent [19]

Ostapovich et al.

[11] Patent Number: 5,211,230

[45] Date of Patent: May 18, 1993

[54] METHOD FOR ENHANCED OIL RECOVERY THROUGH A HORIZONTAL PRODUCTION WELL IN A SUBSURFACE FORMATION BY IN-SITU COMBUSTION

[75] Inventors: Eugene Ostapovich; Farrokh N. Pebdani, both of Calgary, Canada

[73] Assignee: Mobil Oil Corporation, Fairfax, Va.

[21] Appl. No.: 839,412

[22] Filed: Feb. 21, 1992

[51] Int. Cl.[5] ..... E21B 47/00; E21B 47/06; E21B 43/243

[52] U.S. Cl. ..... 166/245; 166/251; 166/263; 166/50

[58] Field of Search ..... 166/50, 245, 251, 256, 166/261, 263

[56] References Cited

U.S. PATENT DOCUMENTS

| | | | |
|---|---|---|---|
| 2,788,071 | 4/1957 | Pelzer | 166/251 X |
| 3,036,632 | 5/1962 | Koch et al. | 166/256 |
| 3,394,759 | 7/1968 | Carey | 166/256 |
| 3,608,637 | 9/1971 | Lumpkin et al. | 166/256 |
| 3,794,113 | 2/1974 | Strange | 166/245 |
| 3,865,186 | 2/1975 | Von Hippel et al. | 166/256 |
| 4,410,216 | 10/1983 | Allen | 166/50 X |
| 4,422,505 | 12/1983 | Collins | 166/245 X |
| 4,454,916 | 6/1984 | Shu | 166/260 |
| 4,474,237 | 10/1984 | Shu | 166/261 |
| 4,566,536 | 1/1986 | Holmes | 166/251 |
| 4,598,770 | 7/1986 | Shu et al. | 166/245 |
| 4,625,800 | 12/1986 | Venkatesan | 166/256 |
| 4,651,826 | 3/1987 | Holmes | 166/251 |
| 4,682,652 | 7/1987 | Huang et al. | 166/50 X |
| 4,993,490 | 2/1991 | Stephens et al. | 166/261 |

*Primary Examiner*—George A. Suchfield
*Attorney, Agent, or Firm*—Alexander J. McKillop; George W. Hager, Jr.

[57] ABSTRACT

A horizontal production well is located in the lower portion of a heavy viscous oil-bearing reservoir. A vertical injection well is located in the upper portion of the reservoir. Oxygen-enriched gas is injected down the injector well and ignited in the upper portion of the reservoir to create a combustion zone that reduces viscosity of oil in the reservoir as the combustion zone advances downwardly toward the horizontal production well, the reduced-viscosity oil draining into the horizontal production well under force of gravity.

2 Claims, 2 Drawing Sheets

METHOD FOR ENHANCED OIL RECOVERY THROUGH A HORIZONTAL PRODUCTION WELL IN A SUBSURFACE FORMATION BY IN-SITU COMBUSTION

BACKGROUND OF THE INVENTION

This invention related to a thermal recovery process for recovering viscous oils from subterranean formations and, more particularly, to an in-situ combustion method for recovering such oils through producing wells which extend downwardly from the surface of the earth into the bottom of the oil-containing formation and then extend horizontally through the formation.

In-situ combustion is a commonly known method for recovering heavy viscous oils from subterranean formations. In this method, an oxygen-containing gas is injected into a reservoir through an injection well with ignition of oil within the adjacent reservoir initiated by means for establishing a combustion front. The reservoir is usually provided with one or more vertical production wells for the production of oil. As the flow of oxygen-containing gas to the reservoir is continued, the combustion front is moved from a vertical injection well toward the production wells. The heat generated by burning reduces the viscosity of the oil which is displaced ahead of the combustion front toward the production wells from which the oil is recovered. The combustion front, in displacing the mobile oil, uses the residual carbonaceous deposit as fuel. Examples of such in-situ combustion methods are found in U.S. Pat. Nos. 4,625,800 to Venkatesan; 4,566,536 to Holmes; and 4,474,237 and 4,454,916 to Shu, the teachings of which are incorporated herein by reference.

There are many subterranean formations containing heavy, i.e., viscous, oils. Such formations are known to exist in the major tar sand deposits of Alberta, Canada, and Venezuela, with lesser deposits elsewhere, for example, in California, Utah and Texas. The API gravity of the oils in these deposits typically ranges from 10° to 6° in the Athabasca sands in Canada to even lower values in the San Miguel sands in Texas, indicating that the oil is highly viscous in nature.

Various problems are associated with the in-situ combustion drive method. There is formed in front of the combustion front and relatively near the vertical injection well, a hot bank of hydrocarbons. The viscosity of this hot bank of hydrocarbons is much less than the viscosity of the hydrocarbons existing in the remainder of the reservoir and near the vertical production well. Thus, the capacity of the reservoir to flow hydrocarbons is much less near the production well than near the injection well. This results in a condition which is sometimes referred to as "fluid blocking". When this condition occurs, flow of the lower viscosity hot bank of hydrocarbons near the injection well is retarded by the slower rate of flow of the higher viscosity hydrocarbons near the production well. Under severe conditions where highly viscous fluids are present in the reservoir, the hydrocarbons near the production well may be relatively immobile and thus may, to a large extent, prevent the hot bank of hydrocarbons from flowing toward and into the production well. This results in a loss of efficiency and an excessive amount of the hydrocarbons may be burned in the reservoir.

It is therefore an object of the present invention to provide an improved method of heavy viscous oil recovery that will overcome such a "fluid blocking" as well as other problems by providing a horizontal production well in the lower part of the reservoir and establishing an in-situ combustion front in the upper part of the reservoir to allow gravity to assist the flow of the hot bank of hydrocarbons from the vertical injection well in the upper part of the reservoir to the horizontal production well in the lower part of the reservoir. Utilization of a horizontal production well will allow extended contact with the overlying reservoir, thereby facilitating gravity drainage and production of the heavy viscous oils from the overlying in-situ combustion zone.

SUMMARY OF THE INVENTION

In accordance with the present invention, there is provided a method for the enhanced recovery of heavy viscous oil from a subterranean, oil-bearing reservoir. At least one horizontal production well is located in a lower portion of the reservoir and at least one vertical injection well is located in an upper portion of the reservoir. Oxygen-enriched gas is injected down the injector well into the upper portion of the reservoir. Such gas is ignited in the upper portion of the reservoir to create a combustion zone that reduces the viscosity of oil in the reservoir as the combustion zone advances downwardly toward the horizontal production well, the reduced viscosity oil draining into the horizontal production well under force of gravity.

In a more specific aspect, at least one vent well is located in the reservoir. The oxygen concentration and flue gas is monitored in the horizontal production well. Gas injection into the upper portion of the reservoir is terminated and oxygen and flue gas is vented from the reservoir when a predetermined amount of oxygen is monitored within the horizontal production well. Oxygen concentration is monitored in the vent well. The vent well is shut in when a predetermined amount of oxygen is monitored, thereby allowing the reservoir to consume remaining oxygen in the reservoir. The reservoir pressure is monitored. Oxygen-enriched gas is reinjected down the injection well when the monitored reservoir pressure falls below a predetermined level. The foregoing steps may be cyclically repeated.

In a further aspect, a plurality of horizontal production wells are located in spaced-apart parallel positions within the lower portion of the reservoir. A plurality of vertical injection wells are located in the upper portion of the reservoir, one such injector well being positioned intermediary of each pair of horizontal production wells. Oxygen-enriched gas is injected down each of the injection wells into the upper portion of the reservoir. The gas injected down each vertical injector well and into the upper portion of the reservoir is ignited to create a combustion zone that reduces the viscosity of oil in the reservoir as the combustion zone advances downwardly toward the plurality of horizontal production wells, such reduced viscosity oil draining into the plurality of horizontal production wells under force of gravity.

In a still further aspect, a plurality of vent wells are located in the reservoirs, a pair of such vent wells being positioned intermediary of each pair of horizontal production wells and on opposite sides of one of the intermediary injector wells.

DESCRIPTION OF THE PREFERRED EMBODIMENT

Figure 1:
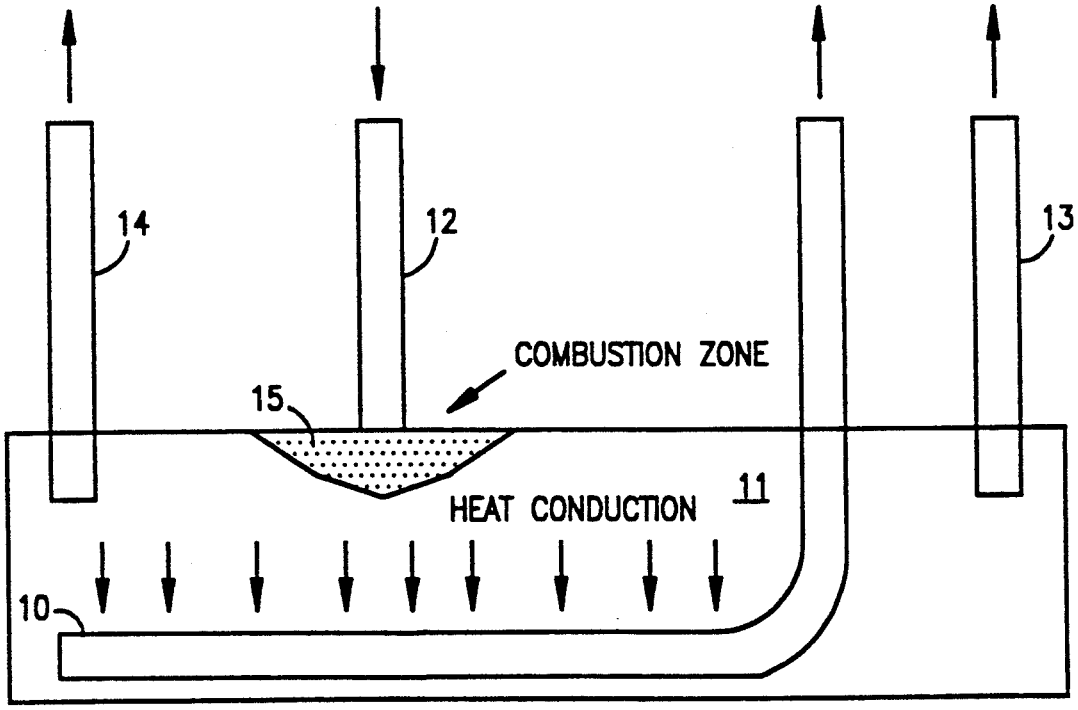
FIG. 1 illustrates the in-situ combustion method of the present invention with a vertical injector well, a horizontal production well and a pair of vent wells.

FIG. 1 shows the preferred well pattern for carrying out the in-situ combustion method of the present invention for recovery of heavy viscous oils. A horizontal production well is located along the lower portion of a heavy viscous oil-containing reservoir 11. A vertical injector well 12 extends to the upper portion of the reservoir 11. A pair of vent wells 13 and 14 also extend into the upper portion of reservoir 11.

Air or oxygen is injected down the vertical injection well 12 and the upper part of the reservoir at the lower end of the injector well 12 is ignited in conventional manner, such as using standard downhole burners. An in-situ combustion zone 15 spreads over the top of the reservoir above the horizontal production well 10. The heat generated by such combustion process, where temperatures could reach 2000° F., is conducted downward, thereby reducing the viscosity of the in-situ heavy viscous oil in the reservoir 11. This in-situ combustion process takes advantage of the gravity drainage mechanism to drain the heated heavy viscous oil into the horizontal production well 10 in the lower portion of the reservoir 11.

After the combustion zone 15 has been ignited, the following process is operated in a cyclical mode. Air or oxygen is injected down injection well 12 and the reservoir 11 is pressurized up while the heavy viscous oil is produced through horizontal production well 10. Oxygen concentration and amount of flue gas in the horizontal production well is monitored and, once it exceeds a predetermined oxygen level, such as 5 Molar percent for example, the oxygen injection is terminated and the vent wells 13 and 14 are opened by suitable valves (not shown) to relieve the reservoir 11 from these gases. This will eliminate the vapor locking of the horizontal production well 10 and also eliminate the corrosion in the tubulars. Once oxygen levels in the vent wells 13 and 14 increase, as measured by routine chromatographic techniques, to a level of 5 Molar percent for example, they are shut in and the reservoir 11 is allowed to consume the remaining oxygen. Then, when the reservoir pressure, as measured by routine methods, falls below a predetermined level, such as 25% of average reservoir pressure for example, oxygen injection through the vertical injector well 12 is resumed. This cyclical operation is continued until a 60–80% recovery of the hydrocarbons in place is realized.

Figure 2:
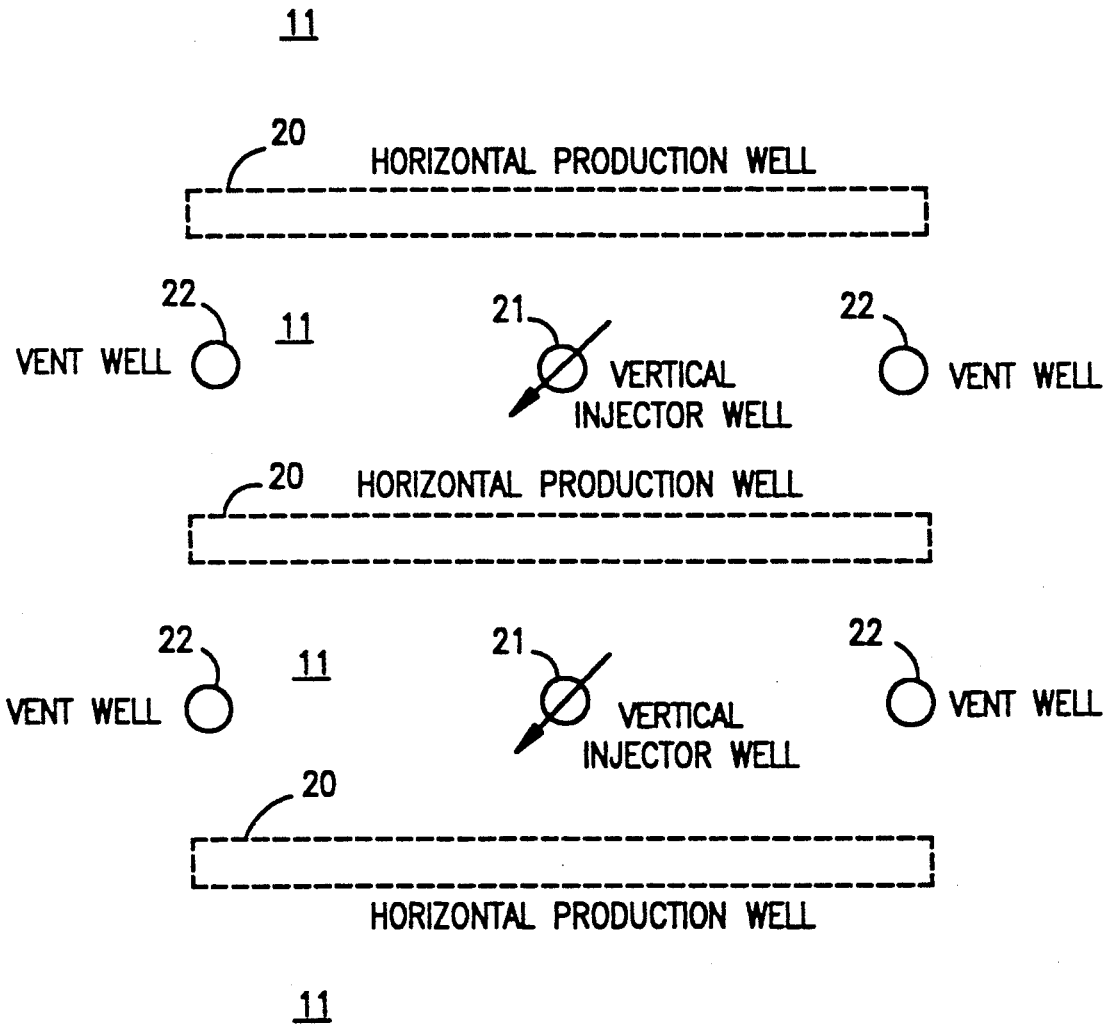
FIG. 2 illustrates the in-situ combustion method of the present invention as being carried out with a plurality of horizontal production wells with intermediary vertical injector wells and vent wells.

FIG. 2 illustrates the in-situ combustion method of the present invention as being carried out with a plurality of horizontal production wells 20 spaced apart in the lower portion of the reservoir 11 and a plurality of vertical injector wells 21 and vent wells 22 spaced at intermediary positions between each of the horizontal production wells 20 so as to provide for a more effective recovery of heavy viscous oil in a reservoir.

While the foregoing has described a preferred embodiment of the present invention, it is to be understood that various modifications or changes may be made without departing from the spirit and scope of the invention as set forth in the appended claims.

We claim:

1. A method for the enhanced recovery of a heavy viscous oil from a subterranean, oil-bearing reservoir, comprising the steps of:

a) locating at least one horizontal production well in a lower portion of said reservoir, b) locating at least one vertical injector well in an upper portion of said reservoir.

locating at least one vent well in said reservoir, d) injecting an oxygen-enriched gas down said injector well into the upper portion of said reservoir.

e) igniting said gas in the upper portion of said reservoir to create a combustion zone that reduces the viscosity of oil in said reservoir as said combustion zone advances downwardly toward said horizontal production well, said reduced viscosity oil draining into said horizontal production well under force of gravity, f) monitoring oxygen concentration and flue gas in said horizontal production well, terminating gas injection into the upper portion of said reservoir and venting the oxygen and flue gas from the reservoir through said vent well when a predetermined amount of oxygen is monitored in step f) within said horizontal production well, h) monitoring oxygen concentration in said vent well, i) shutting in said vent well when a predetermined amount of oxygen is monitored in step h) within said vent well, thereby allowing the reservoir to consume remaining oxygen in the reservoir, j) monitoring reservoir pressure, k) reinjecting said oxygen-enriched gas down said injection well when the monitored reservoir pressure falls below a predetermined level, and l) repeating steps f)–k).

2. A method for the enhanced recovery of a heavy viscous oil from a subterranean, oil-bearing reservoir, comprising the steps of:

a) locating a plurality of horizontal production wells in spaced-apart parallel positions within a lower portion of said reservoir, b) locating a plurality of vertical injection wells in an upper portion of said reservoir, one such injector well being positioned intermediary of each pair of said horizontal production wells, c) locating a plurality of vent wells in said reservoir, a pair of such vent wells being positioned intermediary of each pair of said horizontal production wells and on opposite sides of one of said intermediary injection wells, d) injecting oxygen-enriched gas down each of said injector wells into the upper portion of said reservoir, and e) igniting said gas injected down each of said vertical injector wells and in the upper portion of said reservoir to create a combustion zone that reduces the viscosity of oil in said reservoir as said combustion zone advances downwardly toward said horizontal production wells, such reduced viscosity oil draining into said plurality of horizontal production wells under force of gravity, f) monitoring oxygen concentration and flue gas in said plurality of horizontal production wells, g) terminating gas injection down said plurality of injection wells into the upper portion of said reservoir and venting the oxygen and flue gas from the reservoir through said plurality of vent wells when a predetermined amount of oxygen is monitored in step f) within said horizontal production wells, h) monitoring oxygen concentration in said plurality of vent wells, i) shutting in said plurality of vent wells when a predetermined amount of oxygen is monitored in step h) with said vent wells, thereby allowing the reservoir to consume remaining oxygen in the reservoir, j) monitoring reservoir pressure, k) reinjecting said oxygen-enriched gas down said plurality of injection wells when the monitored reservoir pressure falls below a predetermined level, and l) repeating steps f)–k).

* * * * *